United States Patent [19]

Hablützel et al.

[11] 4,030,635

[45] June 21, 1977

[54] METHOD AND APPARATUS FOR PRODUCING A CONTINUOUS EVEN STRAND OF FIBERS

[75] Inventors: Kurt Hablützel, Wiesendangen; Hansruedi Lamparter, Winterthur, both of Switzerland

[73] Assignee: Rieter Machine Works, Ltd., Winterthur, Switzerland

[22] Filed: Dec. 4, 1973

[21] Appl. No.: 421,688

[30] Foreign Application Priority Data

Dec. 5, 1972 Switzerland ..... 17649/72

[52] U.S. Cl. ..... 222/55; 19/105; 19/240

[51] Int. Cl.[2] ..... D01G 15/40

[58] Field of Search ..... 222/55, 105, 239, 240; 302/28, 35, 59

[56] References Cited

UNITED STATES PATENTS

| | | | |
|---|---|---|---|
| 3,141,202 | 7/1964 | Linnert et al. | 19/240 |
| 3,412,699 | 11/1968 | Culp et al. | 222/55 X |
| 3,561,643 | 2/1971 | Kloven | 222/55 |
| 3,709,406 | 1/1973 | Binder et al. | 19/240 X |

*Primary Examiner*—Robert B. Reeves
*Assistant Examiner*—Joseph J. Rolla
*Attorney, Agent, or Firm*—Kenyon & Kenyon, Reilly, Carr & Chapin

[57] ABSTRACT

The deviations in measuring the density of the fiber strand caused by manufacturing tolerances in the take-off rolls are monitored by integrating the deviations in densities from a preset value over periodic intervals in a control device. The integrator is controlled by periodic impulse signals and is used to adjust the transporting air stream so as to regulate the pressure drop to achieve an even strand.

12 Claims, 2 Drawing Figures

METHOD AND APPARATUS FOR PRODUCING A CONTINUOUS EVEN STRAND OF FIBERS

This invention relates to a method and an apparatus for producing an even continuous strand of fibers, particularly, at the exit end of least one flock depositing chute connected to a pneumatic flock transporting duct and arranged upstream of a card.

Various methods and apparatus are known for feeding one or a plurality of cards by means of flock depositing chutes. In some cases, in order to feed a continuous strand of fibers which is as even as possible to a card, the density of the strand is measured at the chute exit and the condensation of the flock column in the chute is adjusted by changing the pressure drop acting on the flock column to compensate for any deviations of measured density from a pre-set value. The apparatus for implementing this known method generally uses a pair of rolls at the exit of the chute which act not only as a take-off element for the strand of fibers but also as a gauge or measuring device for measuring the density of the fiber strand. As such, the rolls form a part of a control circuit for influencing the transporting air stream on the pressure drop in the chute. An apparatus of this type is described in Swiss Pat. No. 525,971.

Take-off rolls manufactured according to the usual manufacturing methods, however, are generally not exactly cylindrical nor are the axis and the roll sleeve surface exactly concentric. Thus, as a rule, the rolls are considered satisfactory if their shape and dimensions are within certain tolerances. This, however, has the disadvantage that the fiber strand density values measured by means of such rolls deviate from true density values by the amount of the manufacturing tolerances. This, in turn, can cause corresponding deviations of the measured values with repeated roll revolutions, i.e. periodic deviations, under which circumstances, continuing fluctuation of the control device can result. Further, if a group of cards is controlled by measuring the density at one lead card only, with the measuring function being switched to another card when the first card is stopped, the system will require adjustment of the control device due to different roll tolerances. In order to eliminate these disadvantages, attempts have been made to limit the susceptibility of the control circuit. However, this has not proved entirely satisfactory as the control susceptibility and thus the control precision have also been reduced.

A further source of disturbance has also been found in the irregularities of the fiber material, particularly when flock lumps are carried on by the transporting air stream. As a rule, this causes overcompensation in the control circuit.

Accordingly, it is an object of the invention to facilitate the production of an even continuous fiber strand from a pneumatically fed chute.

It is another object of the invention to compensate for differences in take-off roll construction in a simple reliable manner.

Briefly, the invention provides a method of producing an even continuous strand of fibers at the exit end of at least one flock depositing chute connected to a pneumatic flock transporting duct and arranged upstream of a card. The density of a flock column deposited in the chute is controlled by adapting the pressure drop of the transporting air acting upon the flock column between the entry and the exit as a function of the deviation of the weight per unit length, or the density, of the fiber strand produced at the chute exit with respect to a pre-set weight per unit length or density. The measurement is taken at a through-passing point. This method is characterized in that the deviation of the weight per unit length, or the density, produced is measured and compared periodically over determined transported lengths of the strand with respect to the pre-set weight per unit length or density to produce a difference value. The obtained difference values are then mathematically integrated and the pressure drop in the depositing chute is controlled as a function of the periodically integrated values.

The apparatus according to the invention is characterized in that measuring devices are provided at the through-passing point of the fiber strand at the exit of the depositing chute: These measuring devices are connected with an integrating device controllable by periodic impulse signals.

DESCRIPTION OF THE PREFERRED EMBODIMENTS

Figure 1:
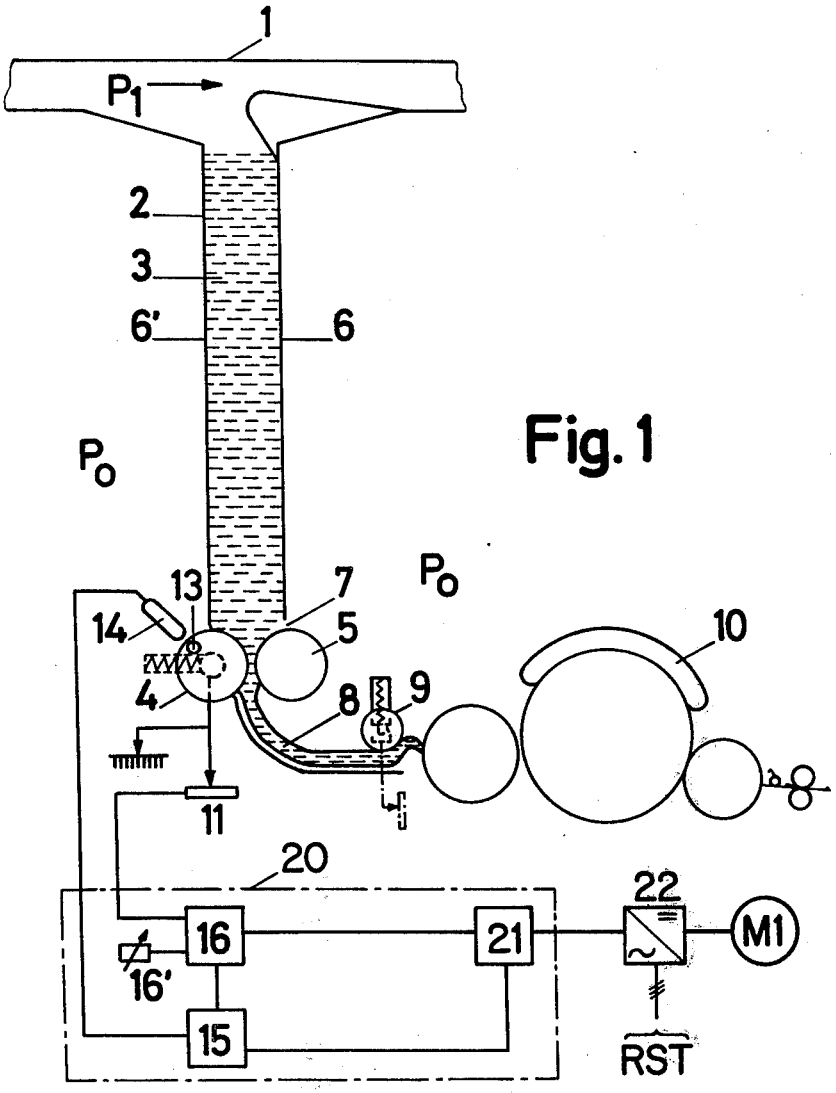
Figure 2:
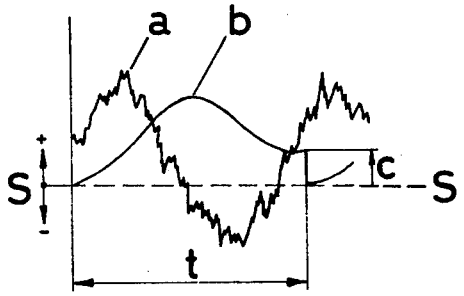

The invention is described in more detail in the following with reference to an illustrated example of an arrangement for producing an even continuous input flock layer to be fed into a card or into a group of cards:

FIG. 1 illustrates an arrangement for continuously producing an even fiber strand and a block diagram of a corresponding control device according to the invention; and FIG. 2 diagrammatically illustrates the action of the control device of the arrangement according to FIG. 1.

Referring to FIG. 1, a pneumatic flock transporting duct 1 is connected to a flock depositing chute 2 in order to deposit flocks brought in via a transporting air stream into a flock column 3 within the chute 2. A pair of rotatably supported take-off rolls 4, 5 is arranged at the lower end of the chute 2 as is known. In addition, a slot-type clearance spare 7 is provided as an outlet for the transporting air flowing through the flock column 3 between at least one of the two take-off rolls 4, 5 and the lower rim of at least one chute wall 6. Instead of one or a plurality of air outlet spares 7 at the lower chute end, one of the two large chute walls 6 or 6' can be provided with vertical air outlet slots arranged at a higher level or extending over a partial height range. Because of the influence of the pressure difference $\Delta p$ between the pressure $p_1$ prevailing above the flock column 3 (i.e. the pressure prevailing in the flock carrying transporting air in the transporting duct 1 at the entry into the chute 2) and the lower pressure $p_o$ (prevailing at the air outlet slot 7 in the air of the room surrounding the chute 2), the flock column 3 is pressed against the take-off rolls 4, 5 and is more or less intensively pre-condensed. As the rolls 4 and 5 rotate, fiber and flock material is taken off the chute 2, is further condensed in passing between the rolls 4 and 5 into a fiber strand or bat 8 and is supplied into a feeding device 9 of a card 10 as a relatively compact fiber layer.

During passage between the take-off rolls 4 and 5 the density of the fiber strand 8 is measured. For this purpose one of the two rolls e.g. the roll 4 is supported yield against a spring action at right angles to the roll axis in the plane determined by the rotational axis of the two rolls, in such a manner that the roll serves as a sensing element. In order to determine the measuring values, a measuring means such as a measuring value transmitter 11 is mounted on the machine frame (not shown) and is connected with a control device 20. The measuring value transmitter 11 serves to transmit the values which are measured to the control device 20. A signal trigger 13 of suitable construction is mounted on the roll 4 used as the sensing element for periodically triggering impulse-type signals. In addition, a signal transmitter 14 is mounted on the machine frame in the action zone of the signal trigger 13 which rotates with the roll 4. This transmitter 14 is triggered by the signal trigger 13, the signal transmitter 14 also being part of the control device 20. Different devices can be chosen for use as a signal trigger 13 or a signal transmitter 14 according to the type of the control device used. Thus, the signal trigger 13 can be e.g. constructed as a cam and the signal transmitter 14 can be constructed as a switch activated by the cam or a contact-free impulse generator can be used instead.

According to the functions to be performed the control device 20 contains different parts which are suitably interconnected. One part of the control device 20 of importance is an impulse-convertor 15 or pulse-convertor which forms a unit together with the impulse trigger 13 and the impulse signal transmitter 14. The unit fuctions as an impulse circuit. The impulse convertor 15 is provided with two outputs emitting signal impulses of different duration, or of different impulse length respectively, corresponding to the further control functions to be performed by the other parts of the control device.

Another part of the control device 20 is a means 16 in the form of a summarizing device or integrator 16 which is connected with the measuring value transmitter 11 to compare the measured values with a desired pre-set value and summarize, i.e. integrate, the differences continuously over subsequent periods of determined duration, e.g. each period being the duration of one revolution of the sensing roll 4. Thus, the means 16 initiates and completes an integration of the difference values in a time period equivalent to a single revolution of the sensing roll 4. For this purpose, the integrator 16 is also connected with the pulse convertor 15 controlled by the impulse transmitter 14. Adjustable presetting devices for pre-setting the desired density of the fiber strand, or the desired weight per unit length, are connected with the integrator 16 and symbolized in the drawing by reference index number 16'.

Another part of the control device 20 is a storage device 21 which is connected with the integrator 16 and the impulse convertor 15. The integrator 16 delivers an integrated value *c* corresponding to the duration of one revolution of the sensing roll 4 to the storage device 21 which is connected with a controllable frequency invertor or with a controllable d.c. generating device 22 with a 3-phase supply network R-S-T for controlling an a.c. or d.c. drive motor $M_1$. After every revolution of the sensing roll 4, the impulse convertor 15 delivers a control signal to the storage device 21 for extinguishing the old value *c* and storing the new value *c*. In order to continuously control the pressure drop $\Delta p$, the value *c* controls the drive motor $M_1$ for the fan (not shown) for the transporting air acting on the pressure side upon the chutes.

The control device 20 operates as a sample and hold unit. The signal transmitter 14 is triggered by the signal trigger 13 after every revolution of the sensing roll 4 and transmits a signal to the impulse convertor 15. After every recolution of the sensing roll 4, the impulse convertor 15 delivers a control signal to the integrator 16 for actuating the integrator 16 to compare the measured density values with the pre-set value, to form the difference values, to integrate the difference values over the time of one revolution of the sensing roll 4 and to form and deliver the integrated value *c* to the storage device 21. After every revolution of the sensing roll 4, the impulse converter 15 also delivers a control signal to the storage device 21 for extinguishing the old value *c* corresponding to the preceding revolution of the sensing roll 4 and storing the new value *c* corresponding to the following revolution of the sensing roll 4. This new value *c* controls the frequency invertor 22 until the next value *c* is received.

The storage device 21 thus acts as a means to produce the signal, i.e. the value *c*, for transmission to the means, i.e. the fan and motor $M_1$, to establish a pressure drop in the chute 2.

The function of the arrangement according to the invention is illustrated in FIG. 2. In the diagram shown in FIG. 2, the curve *a* indicates an example of the deviations of the measuring values continuously transmitted by the measuring value transmitter 11 of the density values measured at each moment during the duration *t* of a measuring period, e.g. one revolution of the sensing roll 4 from the desired pre-set density value. The curve *b* indicates continuously mathematically integrated deviation values *a* of each moment over the same duration *t*. The straight line s-s indicates the desired value of the density of the fiber strand as pre-set on the presetting device 16'. Presetability of the desired value is symbolized in FIG. 2 by arrows marked + and −. The momentaneous deviation values *a* as a rule include, in addition to technologically caused random disturbances, different periodically repeated disturbances, of which e.g. the deviations of the sensing roll 4, or of the rolls 4 and 5 respectively, from the ideal cylindrical form and of the roll sleeve surface with respect to its rotational axis, caused by manufacturing imprecisions are included. It has been found that such periodic disturbances at least substantially follow a sine-function, which integrated over the duration *t* of one revolution of the roll yields the resulting sum O (nil). A resulting sum, or end value respectively, *c* of the line *b* as shown in FIG. 2 thus represents the net correcting value for the adjustment of the pressure drop $\Delta p$, or for the adjustment of the adjusting elements to be acted upon. The end value *c* located above the straight line *s—s* of the present value indicates that the average density of the fiber strand 8, averaged over the measuring period *t*, or within the corresponding transporting distance of the length of one roll circumference was too great.

A substantial advantage of the invention arrangement is seen in that the periodic disturbances acting as described earlier are eliminated.

A further advantage resides in that the integration of the deviations of the measuring values from a pre-set value results in a levelling or smoothing of the measuring value peaks caused by possible flock lumps which may disturb the control.

The advantage mentioned furthermore permit substantial improvements in the precision of the control action, of the production and of the quality of the fiber sliver produced at the card exit.

What is claimed is:

1. A method of producing an even continuous strand of fibers at an exit end of at least one flock depositing chute, said method comprising the steps of delivering fiber flock into the chute at a preset air pressure;

removing air from the chute to create a pressure drop within the chute to compress the flock therein;

removing a fiber strand from the chute between a pair of take-off rolls wherein one of the rolls is a sensing roll;

measuring the density of the fiber strand removed from the chute;

comparing the measured density of the fiber strand with a present value to obtain a difference value;

initiating and completing an integration of the obtained difference values in a period of time equal to a single revolution of the sensing roll; and varying said pressure drop as a function of the integrated difference values to maintain an even continuous strand.

2. A method as set forth in claim 1 wherein a plurality of said chutes are connected to a common flock transporting duct for receiving delivered fiber flock, and said steps of measuring and comparing are performed for one chute to vary the pressure drop in each chute.

3. A method as set forth in claim 2 wherein said pressure drop is continuously controlled as a function of the periodically obtained integrated difference values.

4. An apparatus for producing an even continuous strand of fibers comprising at least one flock depositing chute for receiving a flow of flock laden transporting air to form a fiber flock column within said chute, said chute having an exit for passage of a continuous strand of fiber therefrom;

means to establish a pressure drop in the fiber flock column in said chute to condense the flock column;

means for measuring the density of the fiber strand removed from said chute exit including a pair of take-off rolls, one of said rolls being a sensing roll; and a control device having means for comparing the measured density of the fiber strand with a preset value to obtain difference values and for initiating and completing an integration of these difference values in a time period equivalent to a single revolution of said sensing roll means to produce a signal for transmission to said means to establish a pressure drop to vary said pressure drop as a function of the difference values to maintain an even continuous strand.

5. An apparatus for producing an even continuous strand of fibers comprising at least one flock depositing chute for receiving a flow of flock laden transporting air to form a fiber flock column within said chute, said chute having an exit for passage of a continuous strand of fiber therefrom;

means to establish a pressure drop in the fiber flock column in said chute to condense the flock column;

means for measuring the density of the fiber strand removed from said chute exit including a pair of take-off rolls, one of said rolls being a sensing roll; and a control device having means for comparing the measured density of the fiber strand with a preset value to obtain difference values and for integrating these difference values periodically over determined transported lengths of the strand which correspond to one revolution of said sensing roll to vary said pressure drop as a function of the periodically integrated difference values to maintain an even continuous strand, and an impulse circuit for periodically emitting impulse-type signals, said impulse circuit being connected to said means for comparing and integrating to effect periodic measurements of the deviations of the fiber strand from a pre-set density value.

6. An apparatus as set forth in claim 5 wherein said means for comparing and integrating includes an adjustable pre-setting device for pre-setting device for pre-setting said set value.

7. An apparatus as set forth in claim 5 wherein said control device includes a storage device connected to said means for comparing and inteqrating and to said impulse circuit to receive the inteqrated difference values and which further includes continuously acting adjusting elements connected to said storage device for controlling said pressure drop.

8. An apparatus as set forth in claim 7 wherein said continuously acting adjusting elements include a controllable d.c. generating device and a d.c. motor connected to said generating device.

9. An apparatus as set forth in claim 7 wherein said continuously acting adjusting elements include a controllable frequency invertor and an a.c. motor connected to said invertor.

10. An apparatus for producing an even continuous strand of fibers comprising at least one flock depositing chute for receiving a flow of flock laden transporting air to form a fiber flock column within said chute, said chute having an exit for passage of a continuous strand of fiber therefrom;

means to establish a pressure drop in the fiber flock column in said chute to condense the flock column;

means for measuring the density of the fiber strand removed from said chute exit, said measuring means including a pair of take-off rolls at said exit and at least one trigger on one of said rolls for periodically triggering an impulse-type signal; and a control device having means for comparing the measured density of the fiber strand with a preset value to obtain and integrate difference values and to vary said pressure drop as a function of the integrated difference values to maintain an even continuous strand, and an impulse circuit for periodically emitting impulse-type signals, said impulse circuit being connected to said means for comparing and integrating to effect periodic measurements of the deviations of the fiber strand from a pre-set density value, said impulse circuit including a signal transmitter for receiving the signal from said trigger to periodically actuate said control device.

11. An apparatus as set forth in claim 10 wherein said transmitter is fixedly mounted in a stationary position.

12. An apparatus as set forth in claim 10 wherein said impulse circuit further includes an impulse convertor connected to said transmitter to receive an actuating signal therefrom, said impulse converter being connected to said means for comparing and integrating.

* * * * *